United States Patent [19]

Mäkipirtti et al.

[11] 4,413,816

[45] Nov. 8, 1983

[54] GAS-BLAST PIPE FOR FEEDING REACTION AGENTS INTO METALLURGICAL MELTS

[75] Inventors: Simo A. I. Mäkipirtti, Nakkila; Mauri J. Peuralinna, Harjavalta; Valto J. Mäkitalo, Pori; Launo L. Lilja, Pori; Helge J. Krogerus, Pori, all of Finland

[73] Assignee: Outokumpu Oy, Helsinki, Finland

[21] Appl. No.: 286,039

[22] Filed: Jul. 22, 1981

[30] Foreign Application Priority Data

Aug. 4, 1980 [FR] France ..... 80 2438

[51] Int. Cl.[3] ..... C21B 7/16

[52] U.S. Cl. ..... 266/270; 266/265; 266/268

[58] Field of Search ..... 266/265, 270, 268

[56] References Cited

U.S. PATENT DOCUMENTS 3,779,534 12/1973 Leroy ..... 75/60
4,166,433 9/1979 Kewin ..... 266/265
4,239,194 12/1980 Debaise ..... 266/270

*Primary Examiner*—Peter D. Rosenberg

*Attorney, Agent, or Firm*—Brooks, Haidt, Haffner & Delahunty

[57] ABSTRACT

A device for blowing gas and a finely-divided solid into a metallurgical melt is disclosed, the device having a blast pipe which has at one end an inlet connected to a gas source and at the opposite end an outlet immersed below the melt surface in order to blow the gas into the melt. A cooling device surrounds the blast pipe, the cooling device having, at that end which is near the blast-pipe inlet, inlets and outlets for the cooling medium, and a mantle of ceramic material which surrounds at least the lower part of the cooling device. In the outlet of the blast pipe there is a Laval nozzle which is at an angle to the blast pipe and extends through the thermally insulating mantle. The cooling device further consists of smaller-diameter cooling pipes parallel to the blast pipe, the inlets of the cooling pipes being intended to be connected to a source of a gas-liquid mixture which vaporizes rapidly in the cooling device, and the mantle is surrounded by a graphite or silicon carbide sleeve, which is at least so thick that it protects the ceramic material when the device is lowered into the melt, so that the ceramic material reaches the temperature of the melt more slowly than the sleeve does and sinters before the sleeve wears out.

5 Claims, 3 Drawing Figures

Fig. 1
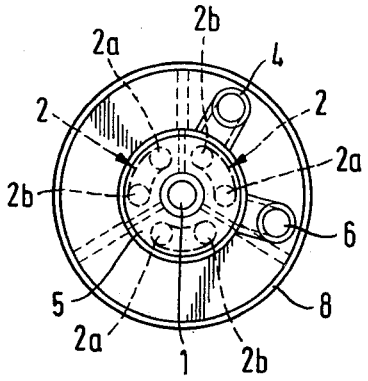
Fig. 2
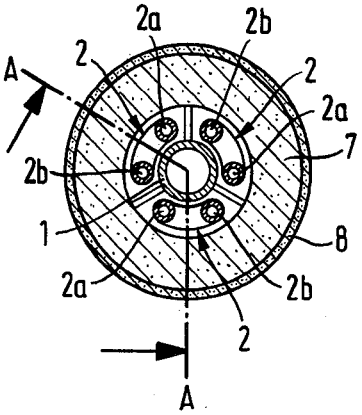
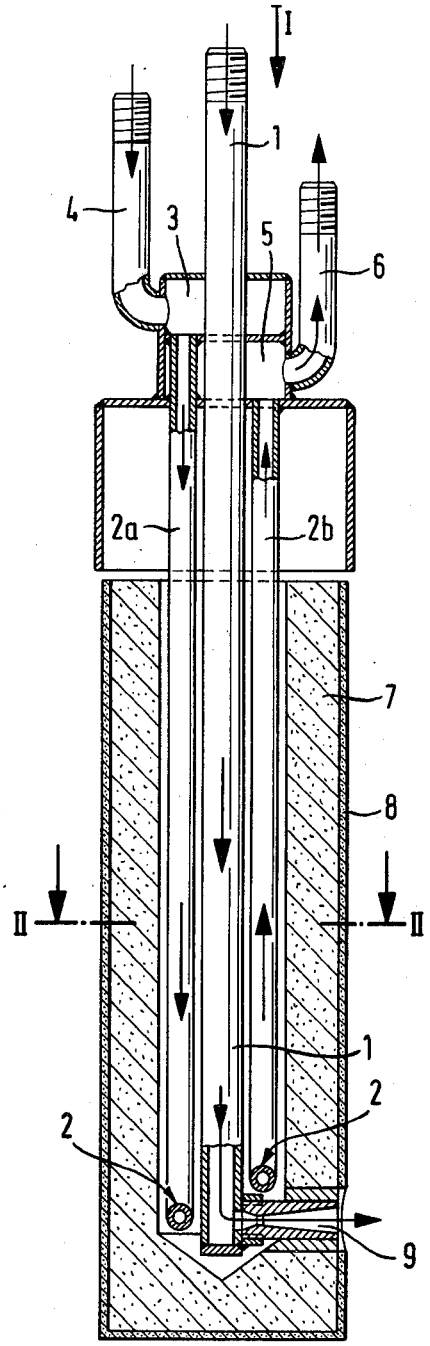
Fig. 3

GAS-BLAST PIPE FOR FEEDING REACTION AGENTS INTO METALLURGICAL MELTS

BACKGROUND OF THE INVENTION

The object of the present invention is a continuous-working gas-blast pipe, partially immersed in a metallurgical melt, for feeding reaction agents into the metallurgical melt. The gas-blast pipe has in the center a reaction-agent pipe, which is surrounded by cooling-medium pipes, parallel to it and having a smaller diameter than the reaction-agent pipe. In addition, the cooling-medium pipes and the reaction-agent pipe are lined with a ceramic material.

Thus, the invention relates to a device by means of which reaction agents, e.g. oxygen-bearing of other reaction gases, are fed into metallurgical melts formed by smelting processes known per se. By means of these reaction agents, the impure products of smelting, for example a sulfur- and/or carbon-bearing one, are converted in the same smelting unit into the final product of conversion processes known per se.

Methods disclosed in various patents are discussed below in order to illustrate the state of the art of devices intended for feeding reaction agents into metallurgical melts.

For feeding reaction agents into metallurgical melts there is, for example, a liquid-cooled oxygen-blast pipe known from U.S. Pat. No. 3,751,019. In liquid cooling, fracturing of the coolant pipe causes the coolant to pass into the melt, a factor which is a work safety hazard owing to the drastic reactions produced. Furthermore, in the said oxygen-blast pipe there is no separate nozzle part at the end of the reaction-agent pipe, and so the velocity of the reaction agent in the blast is low and the penetration of the reaction agent into the metallurgical melt is therefore poor. In addition, the reaction agent is blown vertically in the said oxygen-blast pipe, a factor which sets additional requirements of the material used for lining the floor of the smelting unit.

U.S. Pat. No. 3,843,105 discloses a liquid-cooled, non-continuous-working oxygen-blast pipe. The oxygen-blast pipe is surrounded by cooling-agent pipes, in which the coolant is, for example, water. In addition, at the lower end of the oxygen-blast pipe there are cooling flanges made from copper and coated with a refractory material. Various patents also disclose non-continuous-working devices for blowing gaseous and/or solid reaction agents into metallurgical melts. These devices utilize the cooling effect of liquid cooling methods (FI Pat. No. 40,236, DD Pat. No. 122,313), of reaction slag (DE Pat. No. 2,819,587) and of the blown gas (DE Pat. No. 2,117,714). It must, however, be taken into consideration that these non-continuous-working gas-blast pipes are primarily intended for the conversion methods of the steel industry, in which case the uninterrupted blowing time and possible partial immersion in the melt is only 30–40 min. Therefore, the cooling methods used in them cannot be directly applied to continuous-working gas-blast pipes.

From U.S. Pat. No. 3,529,955 there is known a gas-blast pipe which is installed partly immersed in the melt and in an oblique position in relation to the melt. The gas-blast pipe is cooled by directing a cooling liquid into the reaction-agent pipe situated in the center of the gas-blast pipe; dispersed into small drops and at the same time vaporizing, the cooling liquid passes into the metallurgical melt together with the reaction gas. In this case, the velocity of the gas must be low in order that all the cooling-liquid drops have time to vaporize. On the other hand, a low velocity of the gas has an adverse effect on the penetration of the reaction agent into the metallurgical melt.

Furthermore, U.S. Pat. No. 3,758,090 discloses a blast pipe which is suitable for blowing fuel and oxidizing gas via a tuyere in the wall of the smelting unit. By means of burners, the liquid fuel is caused to burn with oxygen or oxygen-enriched air in the blast pipe. The gas mixture is fed into the smelting unit as a turbulent gas flow through a Laval nozzle known per se, whereby the gas flow velocity increases to a value of 300–500 $ms^{-1}$. Since the blowing takes place through a tuyere, the wall of the smelting unit alone provides sufficient cooling for the blast pipe. Therefore, an actual cooling system need not be constructed for the blast pipe. However, the cooling effect of the tuyere is so great that it at the same time causes a decrease in the melt temperature. Thereby, for example, solidified slag deposits are produced at the mouth of the tuyere, and these deposits clog the tuyere. Furthermore, in order for the tuyere blast to be as effective as a gas-blast pipe partially immersed in the metallurgical melt, tuyeres should be constructed in different parts of the smelting-unit wall, and this would have an adverse effect on the control of the smelting process.

The object of the present invention is to eliminate the disadvantages of the gas-blast pipes described in the above-mentioned patents.

SUMMARY OF THE INVENTION

According to the invention there is provided a device wherein the blast pipe is continuous-working in order to make it possible to maintain, for the formation of an impure product of smelting, the advantageous conditions which are achieved by smelting methods known per se. In addition, the gas-blast pipe is in part immersed in the melt, since the impure product of smelting, having a greater specific gravity, forms below the slag phase of the melt. Furthermore, since the metallic final product of the conversion process is even heavier that the two above-mentioned molten phases, the final product is thus formed below the impure product of smelting.

Accordingly there is now provided a device for blowing gas and possibly a finely-divided solid into a metallurgical melt, in which the outlet of the blast pipe comprises a Laval nozzle which is at an angle to the blast pipe and extends through the thermally insulating mantle, the cooling device consisting substantially of smaller-diameter cooling pipes parallel to the blast pipe, the inlets of the cooling pipes being intended to be connected to a source of a gas-liquid mixture which vaporizes rapidly in the cooling device, and the mantle being surrounded by a graphite and/or silicon carbide sleeve, which is at least so thick that it protects the ceramic material when the device is lowered into the melt, so that the ceramic material reaches the temperature of the melt more slowly than the sleeve does and sinters before the sleeve wears out.

Since the structure of the metallic final product of the conversion process must be as homogeneous as possible, the penetration of the reaction agent blown into the metallurgical melt should reach a certain optimal depth. The penetration of the reaction agent can be improved by using for the blowing of the reaction agent a Laval nozzle, known per se, whereby the velocity of the reaction agent increases to a velocity range of 300–500 $ms^{-1}$, beyond the velocity of sound. Within this velocity range, the size of the gas bubbles forming in the melt is the most advantageous in terms of reaction kinetics. Furthermore, as the reaction agent is blown by means of the gas-blast pipe into the metallurgical melt horizontally in relation to the reaction-agent pipe, the penetration depth can be increased. At the same time, the strains caused by the vertical blast in the lining material of the smelting unit floor in the area in which the entire reaction-agent blast is directed are reduced.

The Laval nozzle of the gas-blast pipe according to the invention is manufactured by sintering a metal alloy, which includes, in addition to chromium, 2–5% by weight cobalt. The sintered metal alloy has poor thermal conductivity, in which case the cooling of the reaction-agent pipe, which is in the center, does not affect the temperature of the metallurgical melt when the temperature of the reaction-agent pipe is 450°–650° C. Furthermore, since the sintered metal alloy used melts at a high temperature and since its tendency to react with the melt is slight, the metal alloy well withstands the temperature of the melt. Thus, no solidified deposits can form from the metallurgical melt around the Laval nozzle and complicate the blowing of the reaction agent into the melt.

The reaction-agent pipe and the cooling-medium pipes around it are lined with a ceramic material. Over the lining material there is, furthermore, a sleeve made from graphite and/or silicon carbide, which protects the lining material from a thermal shock, when the gas-blast pipe is lowered into the metallurgical melt.

The continuous working of the gas-blast pipe according to the invention sets very high requirements on the cooling method and the lining material of the gas-blast pipe.

DESCRIPTION OF THE DRAWINGS

FIG. 1 depicts a top view of a gas-blast pipe according to the invention,

FIG. 2 depicts the cross sectional area of the gas-blast pipe according to the invention, and FIG. 3 depicts the longitudinal section of the gas-blast pipe according to the invention, along line A—A in FIG. 2.

DESCRIPTION OF THE PREFERRED EMBODIMENTS

In the embodiment according to the figures, every other cooling-medium pipe 2 parallel to the reaction pipe and situated around the reaction-agent pipe 1, which is in the center, is a cooling-medium inlet pipe 2*a*, and the remaining ones are cooling-medium outlet pipes 2*b*. All the inlet pipes 2*a* for the cooling medium are connected, at the upper end of the gas-blast pipe, to the same chamber 3, into which the cooling medium is first fed through the feeding pipe 4. Likewise, the outlet pipes 2*b* for the cooling medium have a joint chamber 5, from which the cooling medium is removed through the outlet pipe 6. In addition, each inlet pipe 2*a* is connected, at the lower end of the gas-blast pipe, to at least one outlet pipe 2*b*.

The cooling medium is fed by directing the gas/liquid mixture into the cooling medium inlet pipes 2*a*. The amount of liquid in the mixture is so small that the liquid in its entirety can be caused to convert into saturated vapor in the gas amount fed together with it, already at the inlet temperature of the cooling medium. Thus, there is no liquid cooling medium travelling in the cooling-medium pipes 2, and so, in the event of a possible fracture of the gas-blast pipe, no liquid can flow into the metallurgical melt, but possibly only gas, which is advantageous in terms of work safety. In addition, since the cooling effect of the liquid amount fed in, owing to the higher specific heat of the liquid, is greater than that of a corresponding gas amount, the cooling system 2 included in the invention reduces energy consumption as compared with corresponding gas cooling.

In a gas-blast pipe according to the invention, the reaction-agent pipe 1 and the cooling-medium pipes 2 around it are lined with a ceramic lining material 7. A sleeve 8 made of graphite and/or silicon carbide is placed over the ceramic lining material 7. The sleeve 8 protects the gas-blast pipe according to the invention, when it is lowered into the metallurgical melt, so that the ceramic lining material 7 reaches the melt temperature more slowly than the protecting sleeve 8 does. Thus the ceramic lining material 7 has time to sinter, whereafter it well withstands the temperature of the metallurgical melt and the hot atmosphere above the metallurgical melt.

The feeding of reaction agents into metallurgical melts by means of a gas-blast pipe according to the figures takes place as follows.

A reaction agent, for example oxygen-bearing and/or other reaction gases, is fed into a reaction-agent pipe 1 according to the invention, which is in part immersed in the metallurgical melt. The reaction agent is directed into the metallurgical melt through a Laval nozzle 9, known per se, and the reaction agent thereby reaches a flow velocity, 300–500 $ms^{-1}$, higher than the velocity of sound. Simultaneously with the feeding of the reaction agent, a gas/liquid cooling mixture is fed into the cooling-medium inlet pipes 2*a*, and this mixture is removed through the cooling-medium outlet pipes 2*b*.

EXAMPLES

Example 1

A gas-blast pipe according to the invention was used for converting a sulfur-bearing copper matte, produced by flash smelting, known per se, into blister copper in the same smelting unit on a pilot-plant scale. The gas-blast pipe was lowered through the top of a protrusion on the side of the reaction shaft of the flash-smelting furnace in such a manner that the nozzle end of the gas-blast pipe reached the area of the sulfur-bearing copper matte. During the entire lowering of the gas-blast pipe into the furnace chamber and thereafter, oxygen-enriched air was fed into the reaction-agent pipe and an air/water mixture was fed into the cooling-medium pipes. The amount of oxygen-enriched air fed was sufficient for the conversion of the sulfur-bearing copper matte into blister copper. The reaction agent was fed horizontally through a Laval nozzle into the sulfur-bearing matte phase.

Table 1 shows the thermal balance of a gas-blast pipe according to the invention. In this case, water was fed into the air/water mixture at 0.030 $m^3/h$. A heat amount of 25.2 Mcal (105.5 MJ) per hour was thereby removed from the gas-blast pipe. The temperature of the reaction-agent pipe at the Laval Nozzle was, in the case according to the example, 640° C., when the temperature of the slag around the gas-blast pipe was between 1250° and 1350° C. and the temperature of the copper matte to be converted was between 1200° and 1300° C. The temperature of the removed cooling-medium mixture was simultaneously 95° C.

EXAMPLE 2

In order to reduce the temperature of the reaction-agent pipe and the cooling-medium mixture being removed, mentioned in Example 1, the amount of water fed into the air-water mixture was increased to 0.055 $m^3/h$ in conditions which were in other respects as in Example 1.

Table 2 shows the thermal balance of the gas-blast pipe in a case according to Example 2. In this case, a heat amount of 37.0 Mcal (154.9 MJ) per hour was removed from the gas-blast pipe. The temperature of the cooling-medium mixture was lowered to 64° C. Simultaneously, the temperature of the reaction-agent pipe at the Laval nozzle was lowered to 470° C.

Maintaining at or below 500° C. the temperature of that end of the gas-blast pipe which is in the melt is advantageous in that the refractory materials used well withstand a temperature of ≦500° C. In addition, no solidified deposits are thereby formed from the melt on the outer ceramic lining-material surface of the gas-blast pipe, deposits which would cause clogging of the gas-blast pipe.

TABLE 1

| Balance component | Temperature °C. | Volume flow $\dot{V}$ $Nm^3/h$ | | Amount of heat Mcal/h | MJ/h |
|---|---|---|---|---|---|
| In | | | | | |
| Cooling air | 51 | 292.8 | | 4.656 | 19.488 |
| Cooling water | 25 | 0.030 | | 0.747 | 3.125 |
| Lanced air | 25 | 83.2 | | 0.646 | 2.704 |
| Lanced oxygen | 58 | 25.8 | | 0.450 | 1.884 |
| Total | | | | 6.499 | 27.201 |
| Out | | | | | |
| Cooling air | 95 | 9.9[x] | 40.9[x] | 20.048 | 83.923 |
| + water | | +31.0[x] | | | |
| Excess air | 95 | 368.2[x] | | 8.430 | 35.288 |
| Lanced air | 95 | 83.2 | | 2.461 | 10.300 |
| Lanced oxygen | 95 | 25.8 | | 0.753 | 3.152 |
| Total | | | | 31.692 | 132.663 |
| Amount of heat removed | | | | 25.193 | 105.462 |

[x]mass flow $\dot{m}$ kg/h

TABLE 2

| Balance component | Temperature °C. | Volume flow $\dot{V}$ $Nm^3/h$ | | Amount of heat Mcal/h | MJ/h |
|---|---|---|---|---|---|
| In | | | | | |
| Cooling air | 43 | 295.8 | | 3.960 | 16.576 |
| Cooling water | 25 | 0.055 | | 1.369 | 5.729 |
| Lanced air | 21 | 89.7 | | 0.585 | 2.447 |

TABLE 2-continued

| Balance component | Temperature °C. | Volume flow $\dot{V}$ $Nm^3/h$ | | Amount of heat Mcal/h | MJ/h |
|---|---|---|---|---|---|
| Lanced oxygen | 35 | 31.4 | | 0.332 | 1.390 |
| Total | | | | 6.246 | 26.142 |
| Out | | | | | |
| Cooling air | 64 | 237.7[x] | 329.4 | 39.170 | 163.965 |
| + water | | +55.8[x] | | | |
| Excess air | 64 | 108.6[x] | | 1.675 | 7.012 |
| Lanced air | 64 | 89.7 | | 1.788 | 7.483 |
| Lanced oxygen | 64 | 31.4 | | 0.618 | 2.587 |
| Total | | | | 43.251 | 181.047 |
| Amount of heat removed | | | | 37.005 | 154.905 |

[x]mass flow $\dot{m}$ kg/h

What is claimed is:

1. A device for blowing a gas continuously into a metallurgical melt, comprising: a blast pipe which has at one end an inlet adapted to be connected to a source for the gas and at the opposite end an outlet adapted to be immersed below the melt surface in order to blow the gas into the melt; a cooling device attached to and surrounding the blast pipe, the cooling device comprising substantially smaller-diameter cooling pipes parallel to the blast pipe, the cooling pipes having inlets and outlets being adapted to be connected to a source of a gas-liquid mixture which vaporizes rapidly in the cooling device said inlets and outlets being at that end which is near the blast-pipe inlet; a thermally insulating mantle of ceramic material attached to and surrounding at least the lower part of the cooling device said mantle being further surrounded by a sleeve of graphite or silicon carbide or both, which sleeve is at least so thick that it protects the ceramic material from thermal shock when the device is lowered into the melt, so that the ceramic material reaches the temperature of the melt more slowly than the sleeve does and sinters before the sleeve wears out; and attached to the outlet of the blast pipe a Laval nozzle which is at an angle to the blast pipe and extends through the mantle and its sleeve.

2. A device according to claim 1, in which the blast pipe is mounted in such a position that the gas is ejected from the blast pipe horizontally into the metallurgical melt.

3. A device according to claim 1 or 2, in which the Laval nozzle of the blast pipe is of a sintered metal alloy which includes, in addition to chromium, cobalt 2–5% by weight.

4. A device according to claim 1, in which the cooling pipes comprise inlet pipes, the upper ends of the inlet pipes being connected to a first joint chamber into which the cooling medium is fed, and the lower ends of the inlet pipes being connected to one or several outlet pipes which have a second joint chamber at the upper end of the gas-blast pipe, the cooling medium being withdrawn from this second chamber.

5. A device according to claim 1, in which the Laval nozzle is at an angle of about 90° in relation to the blast pipe.

* * * * *

UNITED STATES PATENT AND TRADEMARK OFFICE

CERTIFICATE OF CORRECTION

PATENT NO. : 4,413,816

DATED : November 8, 1983

INVENTOR(S) : Simo A.I. Makipirtti et al

It is certified that error appears in the above—identified patent and that said Letters Patent is hereby corrected as shown below:

In the Title Page, under Foreign Application Priority Data, France is indicated as the country. The country should be indicated as follows:

--[30] Foreign Application Priority Data

Aug. 4, 1980 [FI] Finland.....80 2438--.

Signed and Sealed this

*Twenty-eighth* Day of *February 1984*

[SEAL]

*Attest:*

GERALD J. MOSSINGHOFF

*Attesting Officer* *Commissioner of Patents and Trademarks*